United States Patent [19]

Dunham et al.

[11] 4,244,072

[45] Jan. 13, 1981

[54] METAL TUBE CLEANING APPARATUS

[76] Inventors: Heyward O. Dunham, 12 Eastview Dr., Mooresville, Ind. 46158; Harry K. Dunham, 11241 Keith Dr., Whittier, Calif. 90606

[21] Appl. No.: 61,608

[22] Filed: Jul. 30, 1979

[51] Int. Cl.[3] ..... B08B 9/02

[52] U.S. Cl. ..... 15/104.1 R; 15/104.19; 134/8

[58] Field of Search ..... 15/104.09, 104.1 R, 15/104.11, 104.14, 104.3 SN, 104.19; 134/8

[56] References Cited

U.S. PATENT DOCUMENTS

| | | | |
|---|---|---|---|
| 2,057,842 | 10/1936 | Nielsen | 15/104.09 |
| 2,090,174 | 8/1937 | Albright | 15/104.1 R X |
| 2,599,077 | 6/1952 | Sturgis | 15/104.19 |
| 2,679,061 | 5/1954 | Baker | 15/104.1 R |

*Primary Examiner*—Edward L. Roberts

*Attorney, Agent, or Firm*—Woodard, Weikart, Emhardt & Naughton

[57] ABSTRACT

A metal blade on a rotary cleaning tool for cleaning heat exchanger tubes, is insulated from companion cutting blades circularly spaced on the tube. A direct current voltage of low level is applied through the flexible cable and central shaft of the cleaning tool and is a part of a circuit including a current amplifier input and the heat exchanger tube being cleaned. As the tool removes foreign matter from the tube, the resistance to current flow from the insulated blade to the tube decreases, and the current level increases. The current signal, which is thereby an input signal analog of the thermo conductance from the sensor blade to the tube, is converted to a voltage analog. The voltage analog signal is then rectified to smooth out the effect of sensor bounce and rotational effects of mechanical drive system for the tool. The output signal from the rectifier is monitored by a zero to one volt DC meter movement and displayed on the meter face, which may include a color coding thereon from red to white or to green, whereby a red or low scale reading is indicative of a dirty or low thermo conductance tube, whereas a reading in the green at the high end of the scale is indicative of a clean or high thermo conductive tube. The visual observation provides the servicing mechanic a measurement base by which he can determine the required cleaning tool insertion rate and cleaning time cycle, and optimize the efficiency of the service provided.

13 Claims, 5 Drawing Figures

METAL TUBE CLEANING APPARATUS

BACKGROUND OF THE INVENTION

1. Field of the Invention

This invention relates generally to apparatus for cleaning tubes in heat exchangers, and the like, and more particularly to apparatus whereby the effectiveness of the cleaning procedure can be readily determined during the procedure.

2. Description of the Prior Art

To function at top efficiency, every tube-type heat exchanger device, whether in a hot water or steam boiler or condenser, or an exchanger for heating or cooling a liquid or gas, requires that the surface of the tubes be clean and scale-free. The formation of mud deposits, or hard or soft scale on the heat transfer surface of the tubes can drastically reduce the flow or heat exchange through the tube walls. Such formations, which may typically occur on the interior wall of the tube may consist of silicates, sulphates, sulphites, carbonates, organic growths or other formations. Some such fouling agents can be corrosive to the tube material. In addition to the detrimental effect from heat transfer inhibition, and possible corrosion of tube material, the accumulation of scale on the inner wall of a tube decreases the area for fluid flow through the tube, and thus interferes with the flow. Accordingly it is desirable to maintain scale-free heat transfer surfaces.

Basically there are two types of mechanical tube cleaning devices, they being the internal type and external type. The internal type is one wherein both the drive motor and the cleaning tool enter the tube. This type is generally used for cleaning straight or curved tubes of large diameters. The external type is one which has the drive motor external to the tube and it drives a cleaning tool by means of a length of rigid hollow shafting or flexible shafting. This type is used for cleaning the small straight tubes found in condensers and heat exchangers used in the refrigeration and air-conditioning industries. Examples of the external drive type are found in U.S. Pat. Nos. as follows:

2,057,852—Nielsen—Oct. 20, 1936
2,090,174—Albright—Aug. 17, 1937
2,559,077—Sturgis—June 3, 1952

The patents identified above disclose devices which are merely examples, and this is by no means all of the devices which have ever been patented or produced for tube cleaning with a tool driven by drive means external to the tube.

One of the problems with the tube cleaning apparatus heretofore known is the fact that it is difficult to determine how well a tube is being cleaned, and how clean the tube is. The reason for this is the very long length of some tubes, and the fact that the end opposite that entered by the tube cleaning tool, is not open to light. Therefore, one has difficulty getting a good perception of how well the tool is cleaning the tube, or how well it has been cleaned, once the tool has been withdrawn. The present invention is intended to assist the workmen in overcoming these problems.

SUMMARY OF THE INVENTION

Described briefly, in typical embodiment of the present invention, the electrical resistance of the foreign deposits on the inner wall of the tube is used in combination with a special tool and indicator circuit to determine the progress of the cleaning action as the tube is being cleaned. A low voltage is applied between the tool and the tube being cleaned, and the resulting current is monitored, amplified, and indicated on a meter. The cleaning tool is rotated in the tube and advanced longitudinally to clean the deposits from the inner wall, and the meter is observed by the operator during the procedure. One of the cutting blades of the tool is used as the electrical conductor for the low voltage circuit.

DESCRIPTION OF THE PREFERRED EMBODIMENT

Figure 1:
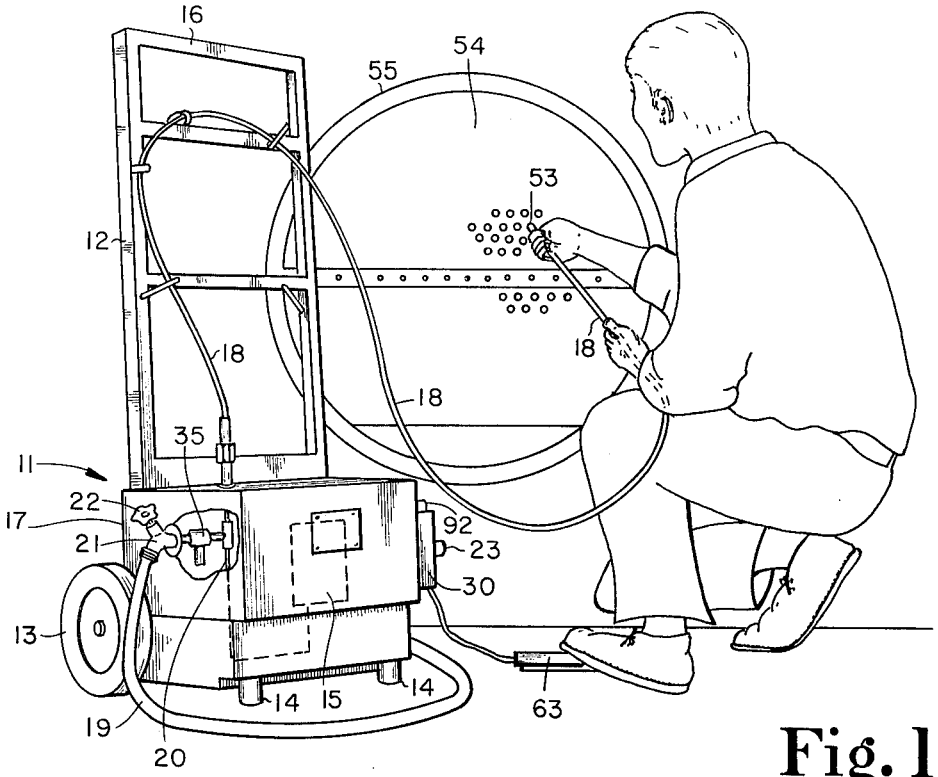
FIG. 1 is a pictorial view of a tube cleaning machine with the operator using the machine to clean one of a plurality of tubes in a heat exchanger.

Referring now to the drawings in detail, a tube cleaning machine 11 includes a support and handling frame 12 having a pair of rubber tired wheels 13 (only one being shown) and a pair of rubber feet 14. The machine is shown resting on a floor, but can be readily tilted back by grasping the upper cross member or handle 16 of the frame, and rolled from place-to-place.

Figure 4:
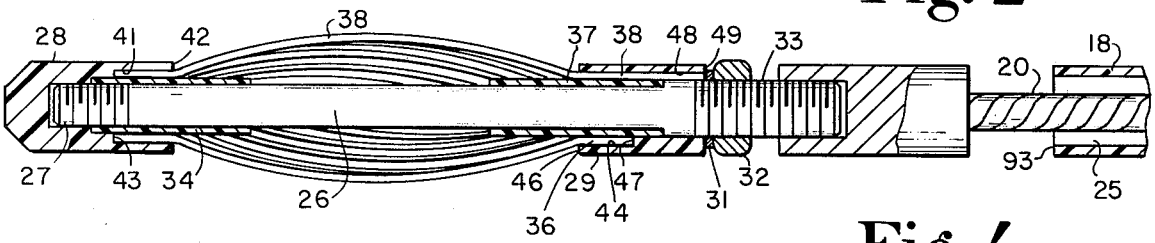
FIG. 4 is a longitudinal section taken at line 4—4 in FIG. 3 but on the same scale as FIG. 2 and viewed in the direction of the arrows.

The machine includes the housing 17, which contains an electric motor 15 which belt drives a flexible cable 20 in the flexible housing or conduit 18 extending from the top of the machine housing 17. At the end of the cable, a cleaning tool such as shown in FIG. 2 is secured to the cable. The housing 18 surrounds the cable at the end of the tool, and the circular space 25 (FIG. 4) between the flexible cable and the conduit 18 can be used to convey a cleaning or washing fluid. For this purpose, a water hose 19 which may be connected to a water hydrant or faucet is connected to the spigot 21 having a valve handle 22 thereon. The internal details of the machine are not a part of the invention and are incorported in a "ream-a-matic" tube cleaner model Ram 2 marketed by Goodway Tools Corporation of 404 West Ave., Stamford, Conn. 06902. A switch 23 on the machine housing can be used to energize signal conditioning circuitry and a power adapter as in box 30 (FIG. 1) for example, as well as energize a foot switch 63 operable, when actuated, to start the motor and thereby the cutting tool, and also turn on the water by the operation of a solenoid valve.

Figure 2:
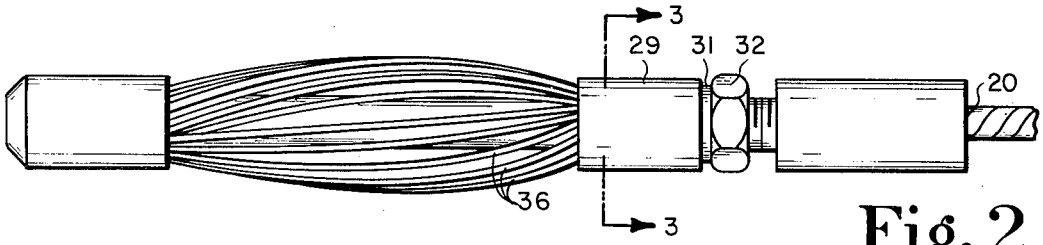
FIG. 2 is an elevational view of a tube cleaning tool according to a typical embodiment of this invention.
Figure 3:
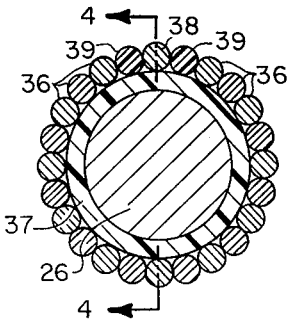
FIG. 3 is an enlarged cross section taken at line 3—3 in FIG. 2 and viewed in the direction of the arrows.

The Goodway Tools Corporation has offered nylon brushes, stainless steel brushes, and a combination cutting/buffing tool, any of which may be used for working on heat exchanger tubes. For purposes of the present invention, the cutting/buffing tool is of primary interest. It is a tool very similar to that shown in FIGS. 2–4 herein and which has a steel shaft such as 26 threaded at the distal end 27 to threadedly receive a head similar to 28 tightly thereon. It has a bushing similar to bushing 29, a washer such as 31, and an adjusting nut similar to nut 32. It has a plurality of wires of round cross section, which are normally straight but which may be bowed outwardly as shown in FIG. 2 by applying axial force against the opposite ends of the wires by tightening the nut such as 32 on the threads 33 on the shaft 26. In this way, the tool can be adapted to cleaning the interiors of various sizes of tubes.

According to one feature of the present invention, the tool is made in a somewhat different way in several respects. First of all, the head 28 and bushing 29 are made of electrically non-conductive material. The circularly spaced wires 36 are still made of steel, as before, but there is an insulating sleeve 34 between shaft 26 and the wires 36 at the distal end of the wires, and an insulating sleeve 37 between the shaft and the proximal ends of the wires. Therefore, these wires are insulated from the shaft.

A further feature is the contact wire 38 which is longer than the other wires, but otherwise may be the same as they are. It is separated from the other wires by insulator wires of nylon such as shown at 39 in FIG. 4 for the proximal ends of the wires, and is likewise separated from the other wires by the same two insulating wires at the distal ends of the cleaning wires and insulator wires. Also, it should be noted that, while the tool head 28 has the annular cavity 41 of uniform length from the proximal end 42 of the head to the remote or distal end wall 43 of the cavity, the sleeve 29 is different in the respect that the cavity 44 therein is of uniform length from the distal end 46 of the bushing 29 to the end wall 47 of cavity 44 except at the location of the contact wire 38, where there is an aperture 48 extending from the end 47 of cavity 44 to the proximal end 49 of the bushing. Accordingly, the wire 38, being longer than the other cleaning wires, extends completely through the bushing into contact with the washer 31 when the washer is tightened against the bushing by means of the nut 32. In this way, we have made available an electrical circuit path from the sensor cleaning blade or wire 38 through the washer 33 and nut 32 to the shaft 26, but the other cleaning blades are insulated from shaft 33. This feature is used in the practice of the invention as will soon become apparent.

Figure 5:
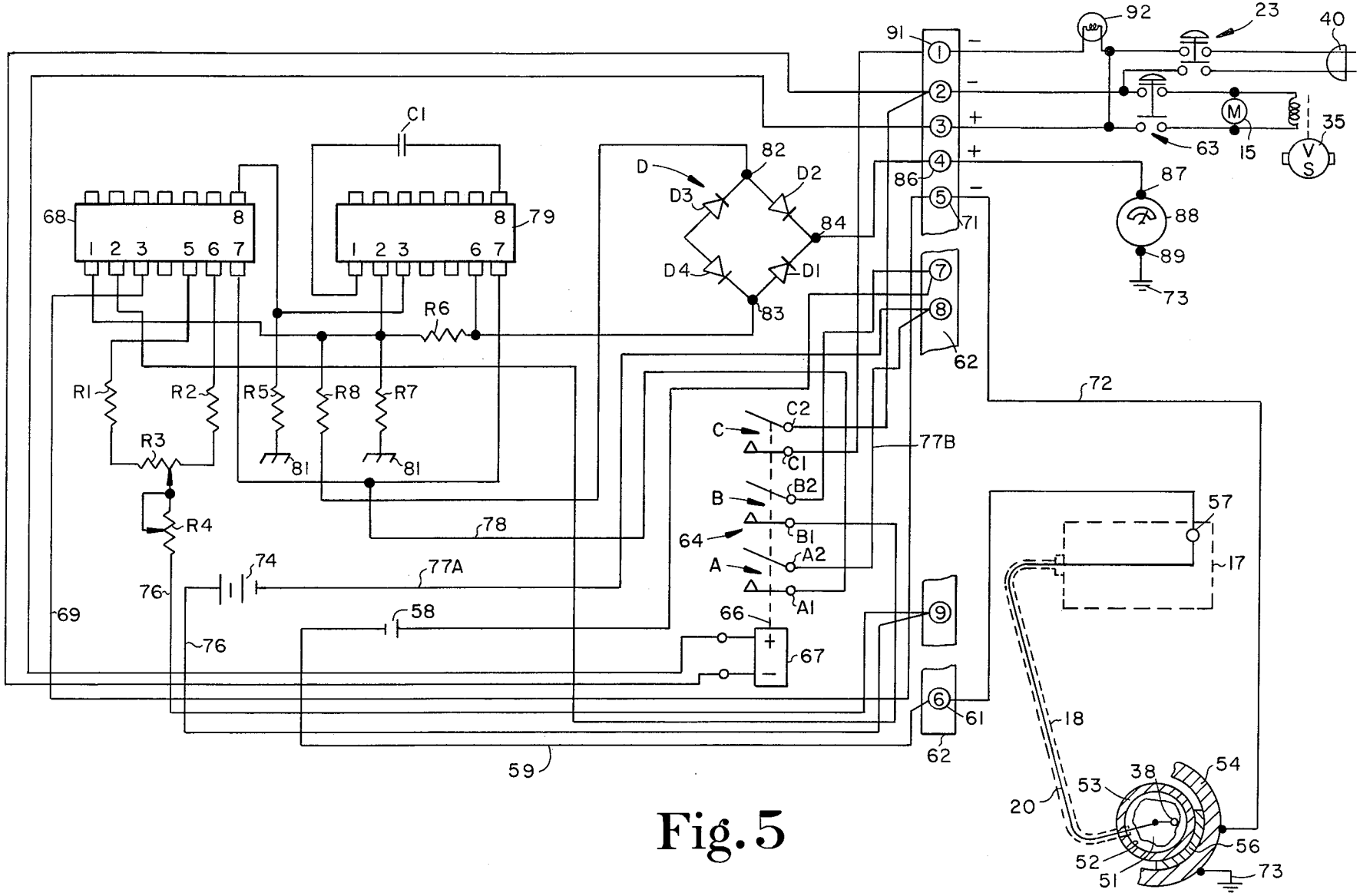
FIG. 5 is an electromechanical schematic diagram of the apparatus and circuitry employed according to a typical embodiment of the present invention.

Referring now to FIG. 5, the housing of the tube cleaning machine is shown at 17 and the flexible cable housing is shown at 18, these being shown in dotted outline to illustrate environment and relate them to FIG. 1. The cable 20 is shown in solid outline and is shown connected to the conductive cutting and sensor blade or wire 38 which is shown in contact with the scale 51 in the inside wall 52 of heat exchanger tube 53. Such tubes are typically connected to some kind of support, and this is represented by a shell 54 secured by weld 56, interference fit, or other electrically conductive attaching means to the tube. An example of such structure would be the tube sheet 54 in the exposed end of the condensor 55 in FIG. 1. Tube 53 may be considered one of the multiplicity of tubes whose ends are shown exposed in the tube sheet 54 in the condenser shell or housing 55 in FIG. 1.

Referring further to FIG. 5, the cable 20 is shown electrically connected to a terminal 57. It should be understood that the cable itself would terminate within the housing 17, and a simple electric connection made from the cable termination to a terminal such as 57 for completing the circuit to the signal conditioning and indicating circuitry of the present invention. This circuitry in FIG. 5 supplies a 1.5 volt direct current potential from the battery 58, the negative terminal of which is connected through conductor 59, terminal 61 on terminal strip 62, and on to the terminal 57 in the tube cleaning machine housing 17. The positive terminal of battery 58 is connected to contact B2 of the solenoid-operated switch assembly 64, having the armature 66 operated by solenoid 67. This solenoid may be activated to close the switch combinations A, B, and C upon closure of the switch 23 supplying alternating current (AC) power when the tube cleaning machine is turned on by operation of the switch 23 in FIG. 1. The other contact B1 of the contact pair B of switch assembly 64 is connected to the pin No. 2 of the integrated circuit 68. This is an LM 321 precision operating current amplifier. Pin 3 of this package 68 is connected through conductor 69 and terminal 71 of the terminal strip 62, and conductor 72 to the shell 54 of the heat exchanger. The shell is returned to ground as indicated at 73.

A nine volt battery 74 has its negative terminal connected through conductor 76 and potentiometers R3 and R4 and resistors R1 and R2, to the pins 5 and 6 of package 68. The positive terminal of battery 74 is connected through conductors 77A and 77B to the contractor A2 of contact section A of the solenoid switch 64. When this section is closed, the positive terminal of battery 74 is thereby connected through contact A1 and conductor 78 to the pins 7 of IC packages 68 and 79. Package 79 is typically an LM 308A operational amplifier. Pins 1 and 8 of that package are connected through capacitor C1. Pin 3 of that package is connected to pin 8 of package 68, and both are coupled through resistor R5 to chassis ground 81. Pin 2 of package 79 is connected to pin 1 of package 68 and through resistor R6 to pin 6 of package 79, and through resistor R7 to chassis ground 81. Pin 2 of package 79 is connected through resistor R8 to the top end 82 of rectifier bridge D, comprising diodes D1, D2, D3, and D4. Pin 6 of package 79 is connected to the lower end 83 of the rectifier bridge D. Junction 84 of the bridge is connected through terminal 86 of the terminal strip 62 to terminal 87 of the voltmeter 88, the opposite terminal of which, 89, is connected to ground 73. Ground 73 for the voltmeter and heat exchanger shell is shown different from chassis ground 81 but should be considered common for purposes of this invention.

Terminal 91 of terminal strip 62 may be connected through the switch section C,C on the solenoid switch assembly to the power switch 23 to turn on a power-on indicator lamp 92 on the tube cleaner housing 17.

OPERATION

In the use of the apparatus according to the invention, the heat exchanger end plate is removed to expose the tube sheet 54 and the tube ends therein. The cleaning tool is adjusted to the proper diameter of blades, compatible with the clean inside diameter of the tubes to be cleaned, this adjustment being accomplished by loosening or tightening the nut 32 to the extent needed to provide the bow of the blades needed to provide the desired diameter. Then the voltmeter is grounded to the tube sheet as is the chassis of the conditioning circuit assembly where the grounds are indicated at 81, for example, in FIG. 5. A water supply may be hooked up to the spigot 21, and an electrical supply hooked up to the switch 23 by plugging plug 40 into an electrical supply outlet. The switch 23 can be turned on to energize the circuitry and, by activating solenoid switches A and B, apply battery voltage from the two batteries 58 and 74. The sensor blade may be placed against the tube sheet and the meter noted for a maximum output reading on the voltmeter 88 to see if the circuitry is operating correctly. A normally-open push-to-test switch in a shunt path across terminals 61 and 71 on terminal strip 62 may also be used for this purose.

Then the tool can be inserted in the first tube to be cleaned, with the open end 93 of the flexible housing inside the end of the tube. Then rotational power can be applied to the cleaning tool by pushing the foot switch 63, and the tool advanced longitudinally inside the tube and operated at each advance until the reading on the meter rises to full scale, indicating a clean tube. As the reading reaches that level, the tool is advanced further into the tube, whereupon the encountering of further scale will normally reduce the meter reading. Then the linear advance of the tool may be slowed until the meter reading again reaches maximum as the tool has cleaned that portion of the tube. This procedure is followed until the tool has advanced through the entire length of the tube to extablish a clean interior of the tube through its length. Then the tool is withdrawn and moved to the next tube in sequence in the heat exchanger.

The utility of this apparatus is practically independent of the length of the tubes cleaned. For purposes of example, some of the components mentioned above and their values are listed here as follows:

Resistors R1 and R2 (matched): 50 Kohms
Potentiometer R3: 10 Kohms maximum
Potentiometer R4: 20 Kohms maximum
Resistors R5 and R6 (matched): 3 Megohms
Resistor R7: 1 Kohm
Resistor R8: 9 Kohms
Capacitor C1: 30 picofarads
Voltmeter 88: 1.0 volt, 4.5 milliampere, full scale To facilitate use of apparatus by the operator, no external adjustments of circuitry are needed. However, the circuitry is factory adjusted by means of the null potentiometer R3 to provide zero measurement threshold when the load resistance (sensor blade to condenser shell, terminal 61 to 71) is 2 megohms. The 2 megohm resistance has been found experimentally by us to be the maximum to be expected in wet scale normally encountered in a water cooled condenser tube, almost regardless of scale thickness. Where the apparatus of the present invention is to be used for cleaning tubes having a different type of scale, such as a boiler fire tube, a load resistance for factory setting potentiometer R3 would need to be selected, based on the maximum resistance of scale likely to be encountered in such tube.

The fine trim potentiometer R4 is factory adjusted with essentially zero resistance (a shunt path across) between terminals 61 and 71 to simulate a clean tube, the adjustment being made to provide maximum signal gain across the IC packages 68 and 69.

If desired, to avoid the need for the two batteries and relay, a DC power supply may be used. This may be an AC to DC power adapter with suitable taps for 0 to 4.5 volts maximum at one tap, and 9 to 12.0 volts maximum at the other tap. The input to the power adapter may be parallel connected directly, or through on-off switch 23, to the line plug 40.

What is claimed is:

1. In apparatus for cleaning heat exchanger tubes or the like wherein said apparatus includes a rotary cutting tool and motor drive means for the tool, the improvement comprising:

first circuit means for applying an electrical voltage between a portion of said tool and said tube;

and current measuring means responsive to current flow in a path of said first circuit means between said tool portion and said tube.

2. The improvement of claim 1 wherein:

said tool has a rotational axis and said tool portion includes a sensor radially spaced from said axis:

3. The improvement of claim 2 wherein:

said sensor includes an electrically conductive wire extending longitudinally of said axis and resiliently bowed radially outward from said axis.

4. The improvement of claim 3 wherein:

said tool includes a plurality of relatively rigid wires extending generally parellel to the axis and arranged in a circular array around said axis, said wires being laterally bowed whereby the longitudinal center portions are further spaced from said axis than the end portions of said wires to serve as deposit cutting blades, and are circularly spaced from each other, said sensor being a relatively rigid wire circularly spaced from said wires of said plurality by insulator members and having a longitudinal center portion bowed outwardly to also serve as a deposit cutting blade.

5. The improvement of claim 4 wherein:

said tool includes a metal shaft and a metal thrust washer and a thrust nut, said washer and nut making an electrically conductive path between said sensor and said shaft end, with said shaft, being a part of said first circuit means.

6. The improvement of claim 5 wherein:

said circuit means further includes a source of electrical energy having one terminal coupled to said shaft and the other terminal coupled through first amplifier means to said tube whereby a signal input circuit is completed.

7. The improvement of claim 6 wherein:

said first amplifier means to have an output;

said current measuring means include a second amplifier means having an input from the output of said first amplifier means, and an output to produce a voltage analog of the current input from said first amplifier means;

and rectifier means coupled to the output of said second amplifier means and having an output with an output signal thereon which is a linear form analogous to the strength of input signal in said signal input circuit resulting from application of said voltage across a variable resistance between the sensor and the tube.

8. A tube cleaning and sensing tool comprising:

a shaft;

cleaner elements arranged lengthwise of the shaft and grouped about the shaft, said cleaner elements being outward curved intermediate their ends; and confining means on the shaft engaging opposite ends of the cleaner elements, at least one of said cleaner elements being in electrically conductive association with said shaft and electrically insulated from others of said cleaner elements to serve as a sensor element.

9. The tool of claim 8 wherein:

said confining means include a retainer head secured to an end of said shaft and a slide axially movable on said shaft adjacent the other end of said shaft;

said cleaner elements having opposite ends confined between said retainer and slide;

and an adjustment nut applying axial force on said slide and thereby axially loading said cleaner elements to bow them radially outward.

10. The tool of claim 9 wherein:

said insulated cleaner element extends axially through said slide to an end opposite the retainer facing end of said slide;

a washer is mounted between said slide and said nut; and axial force is applied against said sensor element through said washer by said nut simultaneously with application of axial force against said other cleaner elements by said nut through said slide, said slide being made of an electrically insulated material.

11. The tool of claim 10 and further comprising:

insulator sleeve means between said shaft and said cleaner elements and electrically insulating said cleaner elements from said shaft.

12. The tool of claim 11 wherein:

said sensor cleaning element is insulated from adjacent others of said cleaner elements by means of intermediate elements of electrically insulating material arranged lengthwise of the shaft and disposed immediately beside on opposite sides of said sensor element in said retainer and in said slide.

13. The tool of claim 12 wherein:

said intermediate elements are cleaner elements confined and bowed outwardly in the same manner as said others of said cleaner elements but made of nylon material.

* * * * *